US008438753B2

(12) United States Patent
Martin

(10) Patent No.: US 8,438,753 B2
(45) Date of Patent: May 14, 2013

(54) SYSTEM, METHOD AND APPARATUS FOR DRYING A SHOWER

(76) Inventor: Josh Martin, New Port Richey, FL (US)

( * ) Notice: Subject to any disclaimer, the term of this patent is extended or adjusted under 35 U.S.C. 154(b) by 396 days.

(21) Appl. No.: 12/858,127

(22) Filed: Aug. 17, 2010

(65) Prior Publication Data

US 2012/0042534 A1 Feb. 23, 2012

(51) Int. Cl.
*F26B 3/00* (2006.01)

(52) U.S. Cl.
USPC ..... 34/381; 34/437; 34/90; 34/105; 34/210; 236/94; D23/271; 454/187; 4/597

(58) Field of Classification Search ..... 34/380, 34/381, 413, 418, 437, 90, 105, 104, 210; 236/13, 236/94; D23/271; 454/184, 187; 4/525, 596, 4/597

See application file for complete search history.

(56) References Cited

U.S. PATENT DOCUMENTS

| | | | | | |
|---|---|---|---|---|---|
| 2,977,455 | A | * | 3/1961 | Murphy | 392/381 |
| 3,128,161 | A | | 4/1964 | Hudon | |
| 3,282,193 | A | * | 11/1966 | Jennings | 454/191 |
| 3,449,838 | A | | 6/1969 | Chancellor, Jr. | |
| 3,587,118 | A | * | 6/1971 | Compton | 4/604 |
| 3,811,198 | A | * | 5/1974 | Baltes | 34/466 |
| 3,878,621 | A | | 4/1975 | Duerre | |
| 4,594,797 | A | * | 6/1986 | Houck, Jr. | 34/225 |
| 4,685,222 | A | | 8/1987 | Houck, Jr. | |
| 4,756,094 | A | | 7/1988 | Houck, Jr. | |
| 4,780,595 | A | | 10/1988 | Alban | |
| 4,857,705 | A | * | 8/1989 | Blevins | 392/381 |
| 4,871,900 | A | * | 10/1989 | Hickman | 392/380 |
| 4,961,272 | A | * | 10/1990 | Lee | 34/90 |
| 4,972,606 | A | * | 11/1990 | Stoltz | 34/271 |
| 5,099,587 | A | | 3/1992 | Jarosch | |
| 5,113,600 | A | * | 5/1992 | Telchuk | 34/90 |
| D335,352 | S | * | 5/1993 | Ristine, III | D24/201 |
| 5,269,071 | A | * | 12/1993 | Hamabe et al. | 34/554 |
| 5,369,892 | A | * | 12/1994 | Dhaemers | 34/275 |
| 5,752,326 | A | * | 5/1998 | Trim | 34/267 |
| 5,930,912 | A | * | 8/1999 | Carder | 34/90 |
| 6,067,725 | A | | 5/2000 | Moser | |
| 6,148,539 | A | | 11/2000 | Hatfield et al. | |
| 6,192,604 | B1 | * | 2/2001 | Morrison | 34/666 |
| 6,718,650 | B2 | | 4/2004 | Ross | |
| 6,962,005 | B1 | | 11/2005 | Khosropour et al. | |
| 7,013,504 | B2 | * | 3/2006 | Brunelle et al. | 4/597 |
| 7,076,887 | B1 | * | 7/2006 | Camberos | 34/90 |
| 7,900,371 | B1 | * | 3/2011 | Bullard | 34/202 |
| 8,112,899 | B1 | * | 2/2012 | Duckworth | 34/202 |

(Continued)

FOREIGN PATENT DOCUMENTS

| | | | | |
|---|---|---|---|---|
| FR | 2747011 | A1 | * | 10/1997 |
| GB | 2222944 | A | * | 3/1990 |
| JP | 2002126678 | A | * | 5/2002 |

*Primary Examiner* — Steve M Gravini

(74) *Attorney, Agent, or Firm* — Larson & Larson, P.A.; Frank Liebenow; Justin P. Miller

(57) ABSTRACT

An application for a shower drying system that directs air downwardly onto the walls, surfaces and/or shower curtain of a shower enclosure. In one embodiment, the air is heated. The movement of the air in the downward direction helps urge droplets of water on the shower surface towards a drain at the lower level of the shower enclosure. Remaining water on the surfaces is evaporated into water vapor that is exhausted from above the shower enclosure, thereby reducing mold and mildew.

20 Claims, 6 Drawing Sheets

U.S. PATENT DOCUMENTS 8,296,875 B2 * 10/2012 Loberger et al. ..... 4/623
2007/0068031 A1 3/2007 Dascher
2012/0042534 A1 * 2/2012 Martin ..... 34/241

* cited by examiner

SYSTEM, METHOD AND APPARATUS FOR DRYING A SHOWER

FIELD

This invention relates to the field of bathroom fixtures and more particularly to a system for drying a shower area.

BACKGROUND

Many homes have showers consisting of a shower head that directs water on a person who seeks to wash themselves. Many showers have at least three walls and either a shower door or a shower curtain, preventing water either directly from the shower head or indirectly from the walls or person from wetting areas outside of the shower stall. Even though the primary purpose of the shower head is to apply water to the person's body for wetting before soaping and for rinsing, it is difficult to prevent water from wetting the walls of the shower and, if present, the shower curtain. The water that wets the walls is of concern, in that, in many environments, the water accumulating, especially in corners, causes mold, mildew, fungus, etc. Furthermore, as water on the walls evaporates, it leaves behind any impurities such as iron, calcium, soap residue, etc, as deposits on the walls and, if present, shower curtain. This residue makes the shower look dirty, covering the shine of wall materials such as tile, glass, etc. Furthermore, the residue provides additional resistance to water flow downward towards the shower drain. During subsequent showers, the residue from previous showers leads to additional retention of water on the walls, thereby leading to additional buildup of deposits, until the walls are later cleaned using cleaning fluids that break down the deposits and rinse them away, often requiring the use of a bristle brush to free the deposits from the wall surfaces.

Early attempt for correct this problem and/or warm a person who is within the shower are described in U.S. Pat. No. 3,128,161 to Marie Antoinette Hudon and U.S. Pat. No. 6,962,005 to Michael Khosropeur. Both provide warm air directed at the occupant of a shower/shower stall from the shower walls. It is unclear that moving air, even heated air, across a wet object (person) will indeed warm the wet object, but perhaps the air is heated to a very high temperature. As for the cleaning aspects, the heated air will increase the rate of drying of the water which was deposited on the walls of the shower during bathing. This may reduce mold and mildew, but has limited effect on reducing build-up of residue and may even increase the build-up due to faster drying not allowing the water to flow down the walls and out the drain. Excessive humidity caused by the rapid evaporation of the water from the walls of the shower may, lead to mold and mildew buildup in other locations in the bathroom and/or house.

What is needed is a system that will dry a shower area, reducing accumulations on the shower walls, floor and/or shower curtain while reducing humidity increases to other areas of the, for example, home.

SUMMARY

A shower drying system directs air downwardly onto the walls, surfaces and shower curtain of a shower enclosure. In one embodiment, the air is heated. The movement of the air in the downward direction helps urge droplets of water on the shower surface towards a drain at the lower level of the shower enclosure. Remaining water on the surfaces is evaporated into water vapor that is exhausted from above the shower enclosure, thereby reducing mold and mildew.

In one embodiment, a shower area drying system is disclosed including a first blower and a second blower. The first blower forces air downward into the shower enclosure from a ceiling above through an aiming device (e.g. louvers or nozzles) and onto surfaces of the shower enclosure, pushing water downwardly along the surfaces of the shower enclosure. The air also creates water vapor from evaporation of some of the water. The second blower exhausts the air and the water vapor from an area above the shower enclosure.

In another embodiment, a method of drying a shower is disclosed including providing a shower drying system comprising a first blower and a second blower. The first blower forces air downward into a shower enclosure from a ceiling above through a device for aiming the air onto surfaces of the shower enclosure (e.g. louvers or nozzles). The air pushes water downwardly along the surfaces of the shower enclosure and also creates water vapor from some of the water evaporating. The second blower exhausts the air and the water vapor from an area above the shower enclosure. The method includes starting the first blower and the second blower then measuring a humidity of the air mixed with the water vapor, stopping the first blower and stopping the second blower when the humidity is at a certain level.

In another embodiment, a shower drier is disclosed including a first blower and a second blower. The first blower receives air from a location external to the shower enclosure and forces the air through a heating element, through input ducting and through a device for aiming (e.g. louver or nozzle). The air is directed downward onto walls of the shower enclosure, pushing water downward along the walls and also evaporating some of the water into water vapor. The second blower exhausts the air mixed with the water vapor from the shower enclosure through a vent and through exhaust pipes to an outside area. The vent situated above the shower enclosure.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
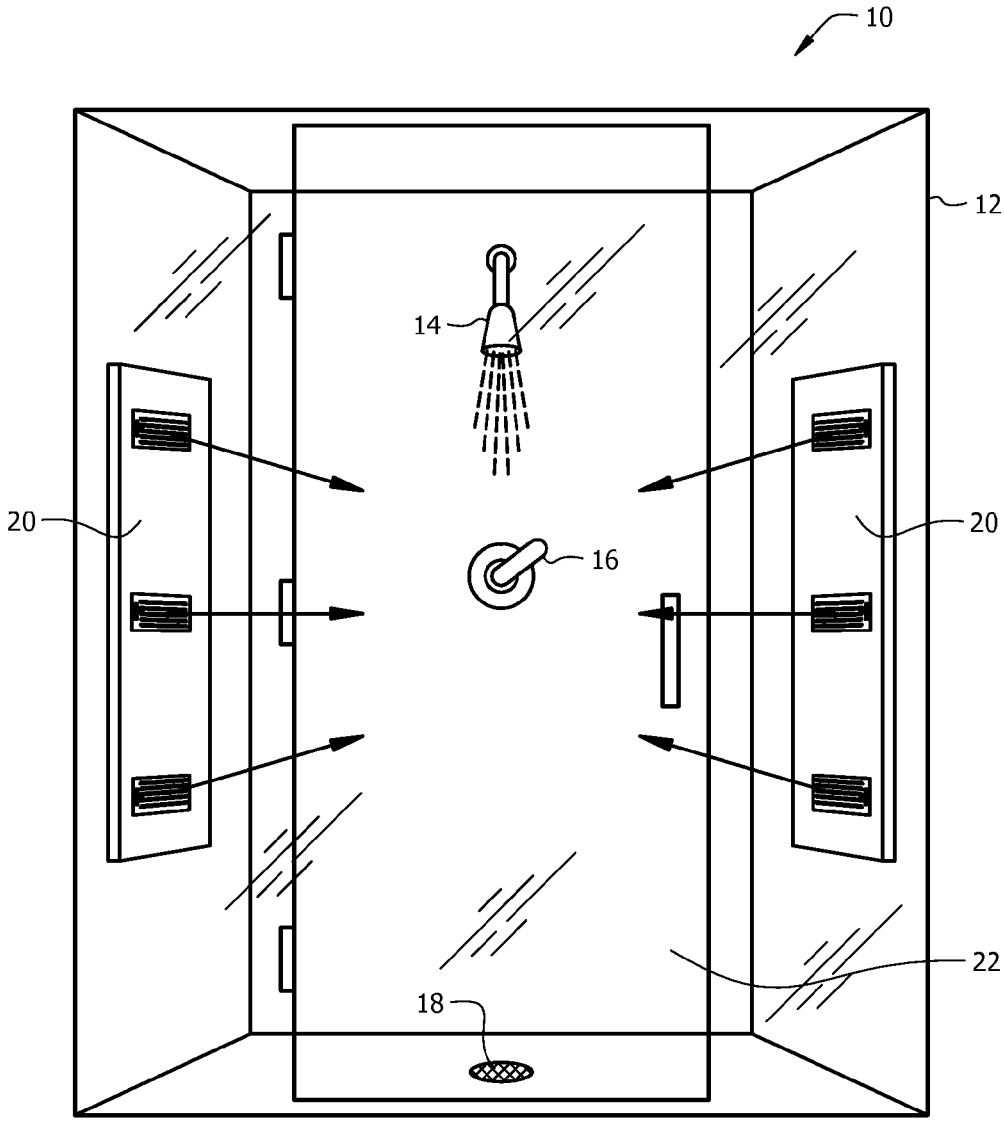
FIG. 1 (Prior Art)
FIG. 1 illustrates a perspective view of a system of the prior art.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a perspective view of a system of the prior art is shown. A typical shower enclosure 10 is shown with a drying system 20 of the prior art. In general, a valve 16 is operated to control the flow of water from the shower head 14 in the direction of a person (not shown) who desires to become cleaner. Ideally, a stream of water flows from the shower head 14, soaking the person, and then exiting the shower enclosure 10 through a drain 18 in the floor area. In reality, the water is often, at least partially, directed at one of the walls 12 of the shower enclosure 10. Additionally, the water often reflects off of the person and onto the walls 12, carrying with it mineral and soap that is dissolved in the water.

The drying system 20 of the prior art blows heated air during cleaning (to "warm" the person) and after the person leaves the shower enclosure 10. Since the warm air is directed towards the central local of the shower enclosure 10, air flow reaching distal sides of the shower enclosure 10 is minimal and results in a gradual drying of the walls 12 by evaporation. The evaporated water, instead of going down the drain 18, enters the air around the shower enclosure 10 as humidity and, potentially, creates a mold and mildew issue in other parts of the containing structure (e.g. home).

Figure 2:
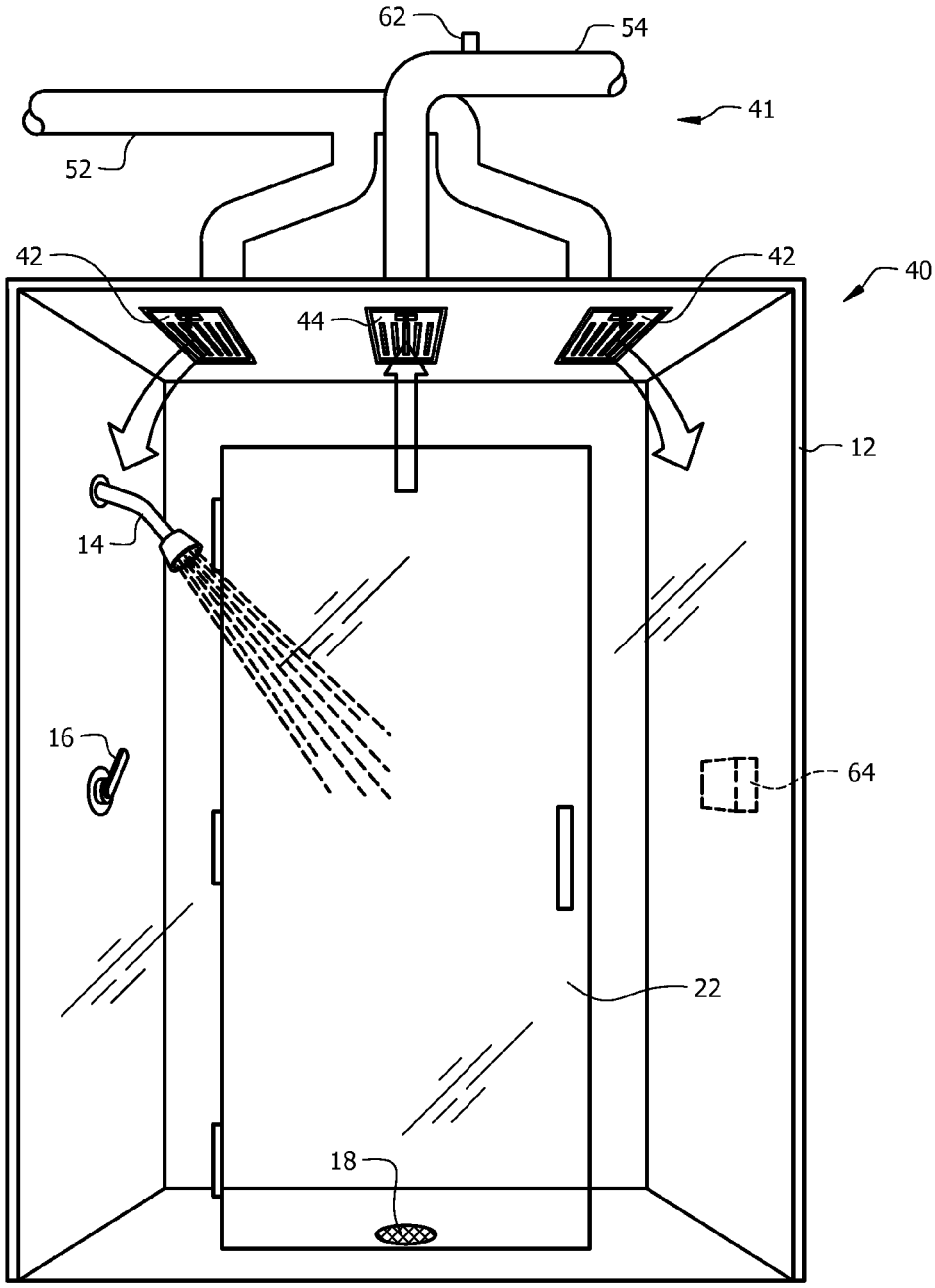
FIGS. 2 and 2A illustrates a perspective view of a system a shower drying system.
Figure 2A:
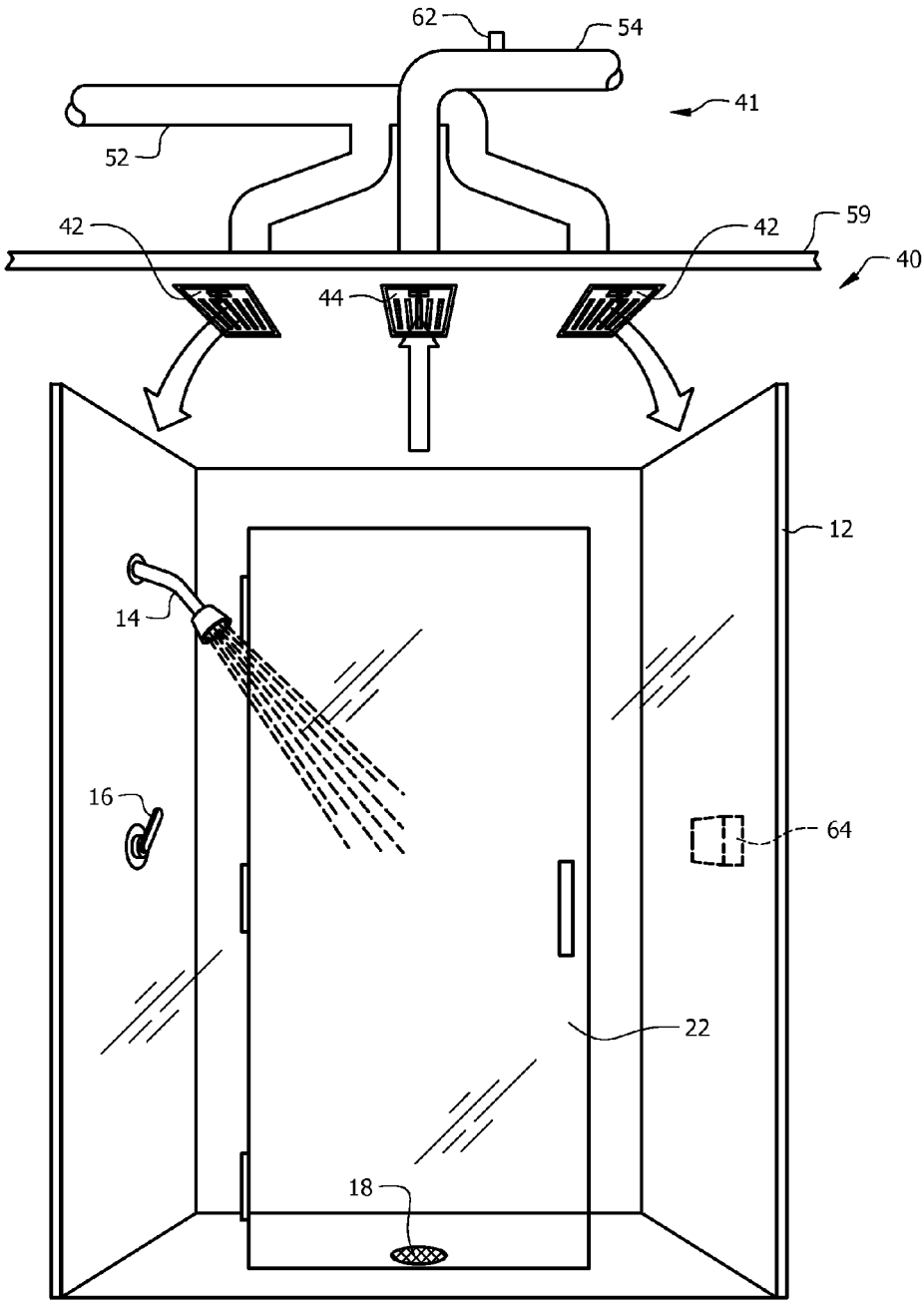

Referring to FIGS. 2 and 2A, a perspective view of a system a shower drying system is shown. A typical shower enclosure 40 is shown with a drying system 41 is shown. In general, a valve 16 is operated to control the flow of water from the shower head 14 in the direction of a person (not shown) who desires to become cleaner. Ideally, a stream of water flows from the shower head 14, soaking the person, and then exiting the shower enclosure 10 through a drain 18 in the floor area. In reality, the water is often, at least partially, directed at one of the walls 12 of the shower enclosure 10. Additionally, the water often reflects off of the person and onto the walls 12, carrying with it mineral and soap that is dissolved in the water.

The drying system 41 blows heated air during cleaning, preferably after the person leaves the shower enclosure 40, from an input ducting system 52 through adjustable louvers 42. The louvers 42 direct warm air downwardly, pushing water droplets 13 (see FIGS. 3 and 4) in a generally downward direction towards the drain. The result is an improved drying of the walls 12 by both channeling the water into the drain 18 and through evaporation. Some of the water, instead of going down the drain 18, evaporates and enters the air around the shower enclosure 10 as humidity. The humid air is evacuated from the central area of the shower enclosure 40 through a grill 44 and exhaust plumbing 54.

The exhaust grill 44 is located in a place where it will receive the most humid air rising from the shower enclosure 40. Likewise, the louvers 42 are located where air or heated air from the louvers 42 is effectively directed onto at least one wall 12 of the shower enclosure (or the shower curtain) to channel water from the walls 12 to the drain 18. Any number of louvers 42 and exhaust grills 44 are anticipated, including one louver 42 and one exhaust grill 44. In embodiments having exactly one louver 42 and one exhaust grill 44, it is preferred that the louver 42 be positioned for aiming air at the wall 12 that receives the most deflected water (e.g., the water that is likely to contain dissolved soap, dirt, dander, etc. from the person using the shower). This is sometimes the wall in which the shower head 14 is located.

In some embodiments, the louvers 42 and/or exhaust grills 44 are mounted in a ceiling of the shower enclosure 40, as shown in FIG. 2. It is anticipated that the louvers 42 and/or exhaust grills 44 are either integrated into the ceiling of the shower enclosure 40 when the shower enclosure 40 is manufactured or added later by the shower installer or, even after the shower is installed, for example by a home owner.

In some embodiments, the louvers 42 and/or exhaust grills 44 are mounted in a ceiling 59 of the bathroom above the shower enclosure 40, as shown in FIG. 2A. It is anticipated that the louvers 42 and/or exhaust grills 44 are installed into the ceiling 59 above the shower enclosure 40 when the bathroom is constructed or added later, for example by a home owner.

It is anticipated that the drying system 41 is controlled in any way known, including a simple on/off control switch (not shown), variable speed controls, push buttons for start/stop, separate controls for each blowers, etc. as known in the industry. In some embodiments, a humidity sensor 62 is integrated into the exhaust plumbing 54. The humidity sensor 62 measures the amount of humidity in the exhausted air. In some embodiments, the blowers 56/58 and/or heaters 60 (see FIGS. 3 and 4) of the drying system 41 are started and operate until the humidity sensor 62 measures a specific level of humidity or a specific decrease in humidity. In some embodiments, there is a minimum running time to allow for evaporation to begin. For example, the blowers 56/58 and/or heaters 60 (see FIGS. 3 and 4) of the drying system 41 operate until the humidity sensor 62 measures humidity less than 50%. As another example, the blowers 56/58 and/or heaters 60 (see FIGS. 3 and 4) of the drying system 41 start, the humidity sensor 62 measures the humidity a few seconds after starting and the blowers 56/58 and/or heaters 60 operate until the humidity sensor 62 measures a decrease in humidity of 8%.

In another embodiment, a room humidity sensor 64 measures the humidity outside of the shower enclosure 40 in, for example, the bathroom. In this, the blowers 56/58 and/or heaters 60 (see FIGS. 3 and 4) of the drying system 41 run until a humidity that is within a specific range of the humidity measured by the outside sensor 64 is measured by the humidity sensor 62. In this embodiment, the drying system 41 is started, then operated until the humidity within or about the shower enclosure 40 approaches the humidity outside of the shower enclosure 40. This accommodates operation in a building that is not climate controlled, in which it is possible that the normal humidity level becomes very high at times. Humidity sensors 62/64 are well known in the industry. There are many ways to control the operation of the shower drying system 41, these being examples of such.

Figure 3:
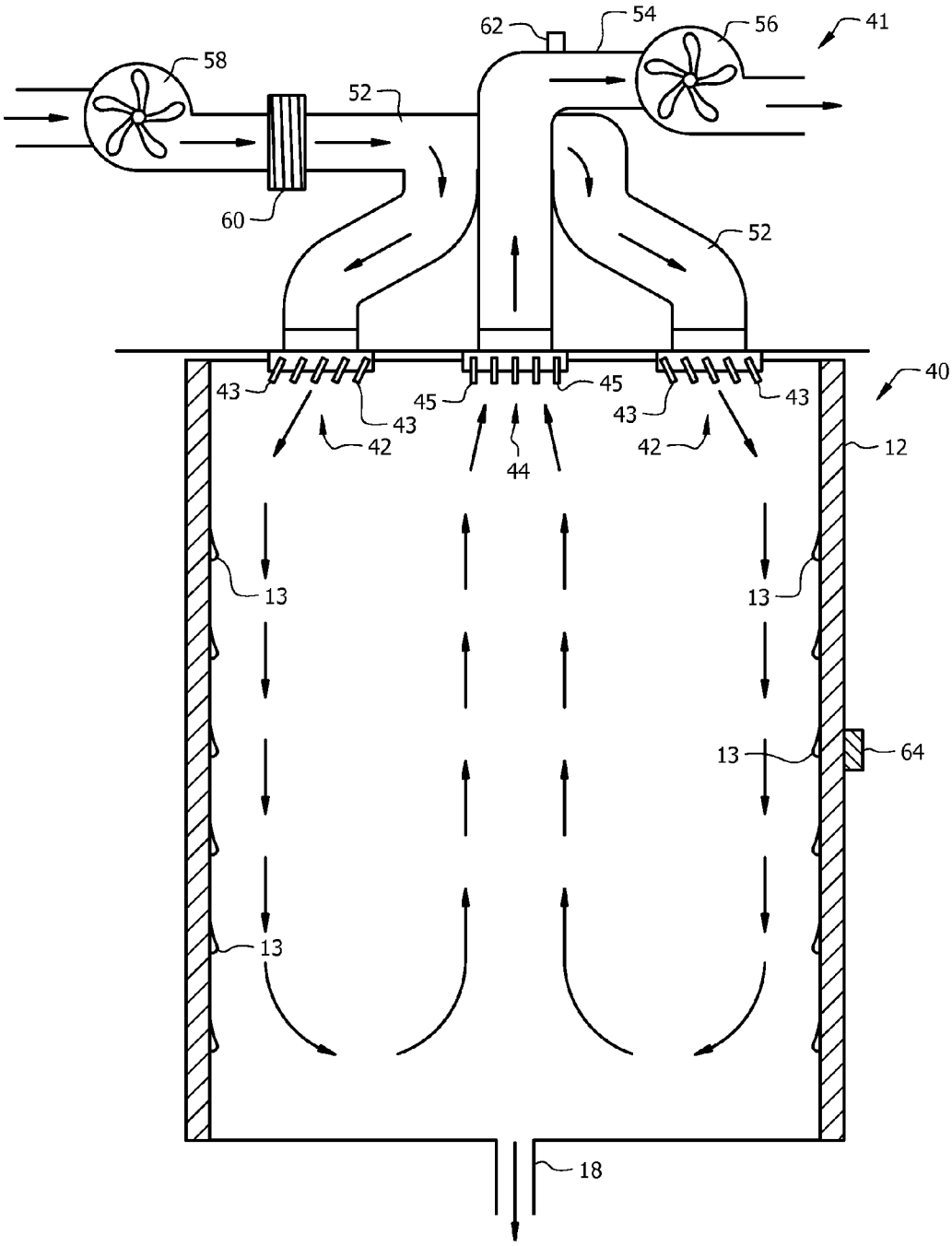
FIG. 3 illustrates a cross sectional view of a system a shower drying system.
Figure 4:
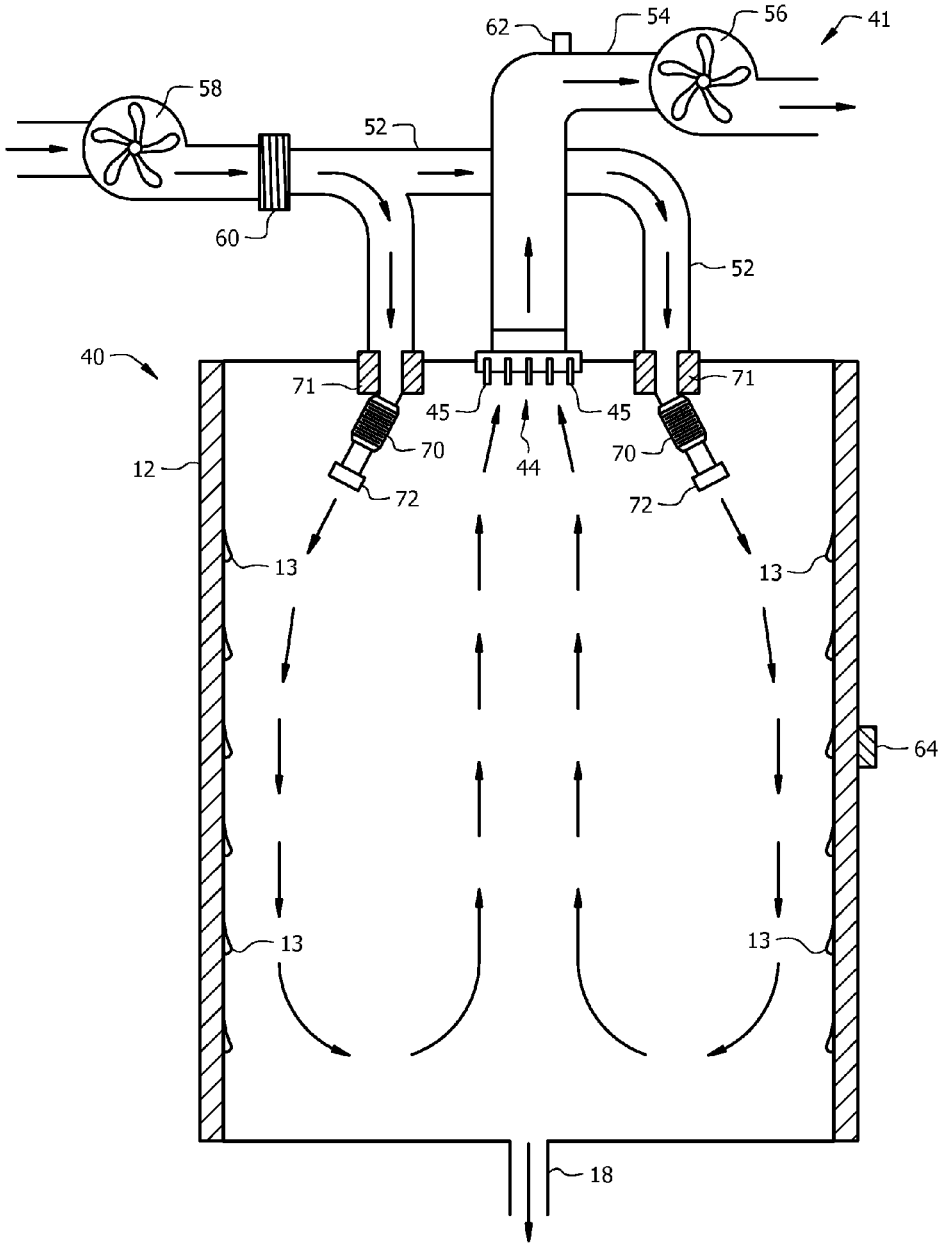
FIG. 4 illustrates a second cross sectional view of a system a shower drying system.

Referring to FIGS. 3 and 4, cross sectional views of a system a shower drying system are shown. For brevity, the shower head 14 and valve 16 are not shown. Although shown in a closed loop, fully enclosed shower enclosure 40, an equivalent system is anticipated for mounting in a ceiling 59 above an open-top shower enclosure as in FIG. 2A.

The shower drying system 41 blows air or heated air downwardly over the shower walls 12, urging the water droplets 13 towards the drain 18. It is anticipated that, as air flows downwardly, the upper water droplets 13 will move downward and meet lower droplets, becoming heavier and eventually migrating downward to meet even more droplets 13, until reaching the floor of the shower stall 40 and eventually the drain 18. It is anticipated that some droplets 13 or moisture on the walls will not flow down the walls 12, but that moisture or droplets 13 will dry faster due to the air flow and/or heated air flow.

In both FIGS. 3 and 4, a first fan or blower 58 blows outside air onto the walls. In preferred embodiments, the air is heated by heating elements 60 (as known in the industry) before reaching the walls 12. Although it is preferred that the air be heated downstream of the first fan 58, it is also anticipated that the heating element 60 is located upstream of the first fan 58, although it is preferred to have the heating element 60 as close to the louvers 42 and/or nozzles 72 as possible. Furthermore, it is anticipated that in some embodiments, the first fan 58 and/or heater 60 is part of a home forced air heating system.

In both FIGS. 3 and 4, a second fan or blower 56 blows humid air from the shower enclosure to an exhaust vent (not shown), preferably outside of the building which houses the shower stall 40. The first fan 58 forces air (or heated air from the heating element 60) through either louvers 42 (FIG. 3) or nozzles 72 (FIG. 4) over the walls 12. The air, now laden with humidity from evaporating water droplets, then circulates upwardly though the center core area of the shower enclosure 40 and is drawn out through the exhaust grill 44 by the second fan/blower 56. In embodiments in which the operation is automated by humidity sensors 62/64, an exhaust humidity sensor 62 is interfaced to the exhaust plumbing 54 for detecting the humidity of the exiting air flow and, optionally, a room humidity sensor 64 is mounted outside of the shower stall 40, for example on an outside surface of the shower stall wall 12 or on another wall of the, for example, bathroom.

There are many ways to aim/direct the forced air coming from the first fan/blower 58 onto the shower walls 12. FIG. 3 shows a first example of aiming/directing the forced air coming from the first fan/blower 58 onto the shower walls 12. In this, the air is directed by blades 43 of the louver 42 as known in the air conditioning industry. It is anticipated that the blades 43 are adjustable at various angles, either together or independently, providing for directing the air over the desired area of the shower stall 40 (or shower curtain, etc). FIG. 4 shows a second example of aiming/directing the forced air coming from the first fan/blower 58 onto the shower walls 12. In this, the air is directed by nozzles 72. In some embodiments, the nozzles are fixed in position while in other embodiments, the nozzles rotate or swivel on the nozzle base 71, providing for aiming and directing the air over the desired area of the shower stall 40 (or shower curtain, etc). In some embodiments, the rate of flow through each of the nozzles 72 is controlled by a valve or baffle 70. In this, each nozzle 72 is provided with a different percentage of the forced air from the first fan/blower 58. The adjustable nozzles 72 are useful when there are restrictions on locating of the shower drying system 41 in the ceiling 59, making some nozzles 72 closer to the walls 12 and some nozzles 72 further away from the walls 72.

Figure 5:
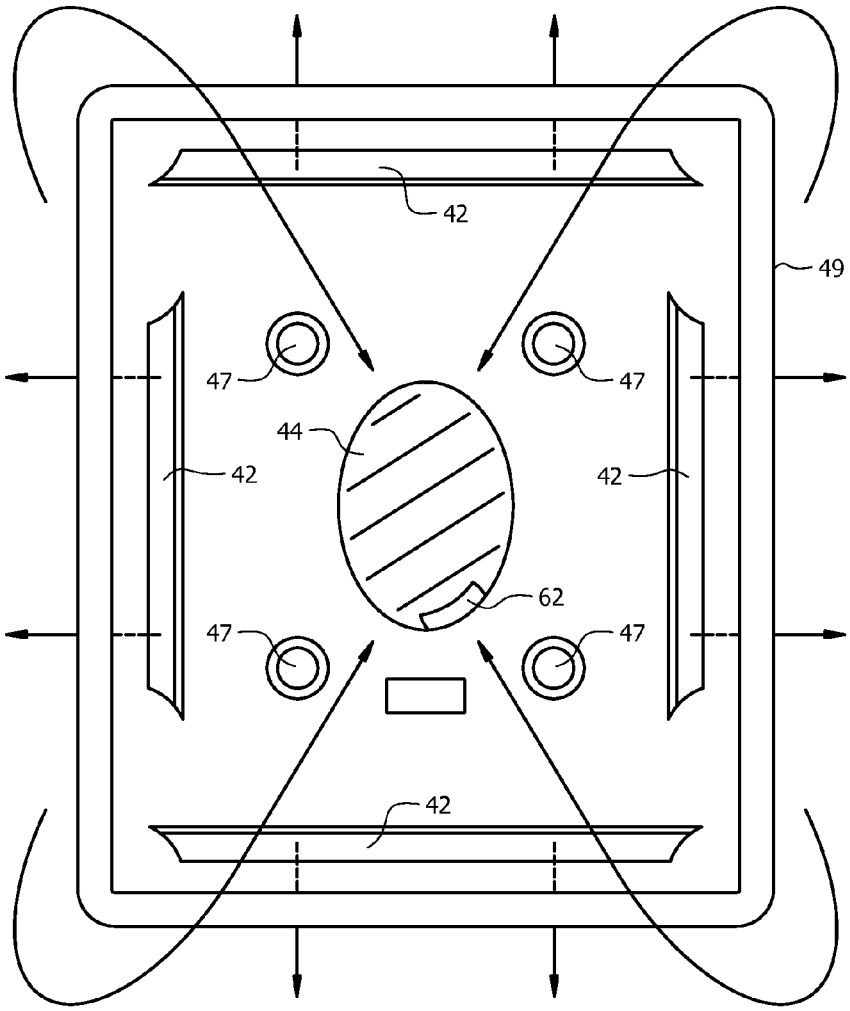
FIG. 5 illustrates a plan view of a typical, integrated shower drying system.

Referring to FIG. 5, a plan view of a typical, integrated shower drying system 49 is shown. The air (preferably heated by heating elements 60) is directed at the walls of the shower enclosure 10 by the louvers 42 or in some embodiments by nozzles 72 (not shown). Humid air from within the shower enclosure 10 is evacuated out the exhaust vent 44. Although it is anticipated that the humidity sensor 62 is mounted at any location in the exhaust pipes 54, in this example, the humidity sensor 62 is mounted just above the exhaust vent 62. In this embodiment, optional lighting 47 is shown, for example, four sets of LED lights 47 or any known light emitting devices.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A shower area drying system comprising:

a first blower, the first blower forcing air downward into a shower enclosure from a ceiling above the shower enclosure;

a means for aiming the air onto surfaces of the shower enclosure, urging water downwardly along the surfaces of the shower enclosure, the air creating water vapor from a portion of the water; and a second blower, the second blower exhausting the air and the water vapor from above the shower enclosure.

2. The shower area drying system of claim 1, wherein the surfaces of the shower enclosure includes rigid walls.

3. The shower area drying system of claim 1, wherein the surfaces of the shower enclosure includes a shower enclosure door.

4. The shower area drying system of claim 1, wherein the surfaces of the shower enclosure includes a shower curtain.

5. The shower area drying system of claim 1, further comprising an exhaust humidity sensor, the humidity sensor situated to measure a humidity of the air mixed with the water vapor, the operation of the shower drying system terminated when the exhaust humidity sensor detects a drop in humidity to a specific level.

6. The shower area drying system of claim 1, further comprising a humidity sensor, the exhaust humidity sensor situated to measure a humidity of the air mixed with the water vapor, the operation of the shower drying system terminated when the exhaust humidity sensor detects a pre-determined percentage drop in the humidity.

7. The shower area drying system of claim 1, further comprising an exhaust humidity sensor and a room humidity sensor, the exhaust humidity sensor situated to measure an exhaust humidity of the air mixed with the water vapor, the room humidity sensor situated to measure a room humidity of the room in which the shower enclosure is located, the operation of the shower drying system terminated when the exhaust humidity is within a pre-determined value of the room humidity.

8. The shower area drying system of claim 1, further comprising louvers, the louvers aiming the air onto walls of the shower enclosure.

9. The shower area drying system of claim 1, further comprising nozzles, the nozzles aiming the air onto walls of the shower enclosure.

10. The shower area drying system of claim 9, wherein airflow through the nozzles is adjustable.

11. The shower area drying system of claim 9, further comprising a source of heat interfaced with the air, heating the air before the air reaches the surfaces of the shower enclosure.

12. A method of drying a shower comprising:

providing a shower drying system comprising a first blower, the first blower forcing air downward into a shower enclosure from a ceiling above, a means for aiming the air onto surfaces of the shower enclosure, urging water downwardly along the surfaces of the shower enclosure, the air creating water vapor from some of the water, and a second blower, the second blower exhausting the air and the water vapor from the shower enclosure;

starting the first blower and the second blower;

measuring a humidity of the air mixed with the water vapor; and stopping the first blower and stopping the second blower when the humidity is at a certain level.

13. The method of claim 12, further comprising a step of heating the air.

14. The method of claim 12, further comprising a step of aiming the air onto the surfaces of the shower enclosure.

15. The method of claim 12, wherein the certain level is pre-determined.

16. The method of claim 12, further comprising a step of measuring an initial humidity after starting the first blower and the second blower, the certain level being a pre-determined decrease in the humidity.

17. A shower drier comprising:

a first blower, the first blower receiving air from a location external to a shower enclosure, the first blower forcing the air through a heating element, through input ducting and through a means for aiming the air downward onto walls of the shower enclosure, the means for aiming situated over the shower enclosure, the air urging water downward along the walls and the air evaporating some of the water into water vapor; and a second blower, the second blower exhausting the air mixed with the water vapor from the shower enclosure through a vent and through exhaust pipes, the vent situated above the shower enclosure.

18. The shower drier of claim 17, wherein the means for aiming is one or more louvers.

19. The shower drier of claim 17, wherein the means for aiming is one or more nozzles.

20. The shower drier of claim 17, further comprising a humidity sensor operatively coupled to the exhaust pipes, the humidity sensor turning the shower drier off when detecting a pre-determined drop in humidity.

* * * * *